United States Patent [19]

Brandli

[11] Patent Number: 4,832,331

[45] Date of Patent: May 23, 1989

[54] ATHLETIC FIELD MARKER

[76] Inventor: Duane L. Brandli, P.O. Box 141, Summerfield, Fla. 32691

[21] Appl. No.: 107,023

[22] Filed: Oct. 13, 1987

[51] Int. Cl.[4] ..... A63C 19/06

[52] U.S. Cl. ..... 272/3; 273/31; 404/12

[58] Field of Search ..... 272/3-5, 272/56.5 SS, 56.5 R; 273/8, 25, 31, 195 R, 195 A, DIG. 13, 176 J, 176 E, 176 H; 47/35; 404/10-14, 35, 36, 41; 15/36, 37, 161, 215, 216, 217, 159 R, 159 A

[56] References Cited

U.S. PATENT DOCUMENTS

| | | | |
|---|---|---|---|
| 3,350,092 | 10/1967 | Maki | 272/56.5 SS |
| 3,959,542 | 5/1976 | Livermore | 272/56.5 SS X |
| 4,103,886 | 8/1978 | Eley | 273/3 |
| 4,128,059 | 8/1980 | Elden | 272/3 X |

FOREIGN PATENT DOCUMENTS

| | | | |
|---|---|---|---|
| 3433258 | 3/1986 | Fed. Rep. of Germany | 272/3 |
| 7908346 | 6/1981 | Netherlands | 272/3 |
| 626811 | 12/1981 | Switzerland | 272/3 |
| 2067418 | 7/1981 | United Kingdom | 272/3 |
| 2150036 | 6/1985 | United Kingdom | 272/3 |

*Primary Examiner*—Henry E. Raduazo

*Assistant Examiner*—Richard E. Chilcot, Jr.

*Attorney, Agent, or Firm*—Alfred E. Wilson

[57] ABSTRACT

For athletic contests between teams of individuals on a field or court it is customary to provide certain markings of the various portions of the field within which the game is conducted. Heretofore it has been common practice to utilize chalk or lime to mark the boundary lines. This method has not been satisfactory because as rain descends the chalk or lime is spread and the field markings are lost. As soon as a contestant runs over the boundary line, as he must in such contests as baseball or football, the marks are obliterated so that it is difficult for the officials judging the game to make proper decisions. I have developed a permanent resilient marker strip which can readily be installed by the use of a trencher to dig a narrow trench into which a resislient base having a plurality of spaced flexible pegs project upwardly to have their tips visible above the surface of the ground. The pegs are closely spaced and are visible over a long distance. When just the tips of the pegs are visible there is no danger of injury to a player in the event that he accidentally contacts or falls on the marker. These markers are available over long periods of time and in the event that one section is injured it can readily be removed and replaced by another section.

2 Claims, 2 Drawing Sheets

ATHLETIC FIELD MARKER

FIELD OF THE INVENTION

This invention pertains to the provision of a permanent marking device which can be buried in the ground so as to be permanently located on the precise boundary of the contest lines and provides an accurate location for the field which need not be checked or corrected at all. This construction thus provides a permanent marking of base or game lines of athletic contests and eliminates the need for individual markings for each game. Once established the markings are available for long periods of time.

DESCRIPTION OF THE PRIOR ART

U.S. Pat. No. 4,103,886, issued to Carl W. Eley on Aug. 1, 1978, is a forerunner of this invention, and it discloses the advantages and broad aspects of a permanent marking structure for marking the score lines of athletic fields.

The Eley patent discloses a construction wherein a plurality of projections or pegs are mounted on a base and are buried in the ground along field marker lines to provide a permanent marking construction that is visible to good advantage as the athletic events progress.

I have found that various improvements are desirable in order to provide a construction that will prove to be more satisfactory in operation over extended periods of time than the construction of the patent, and wherein the construction of the patent can be narrower than illustrated.

SUMMARY OF THE INVENTION

I have found that it is desirable to provide a closer spacing of the base to the upstanding fingers at both the ends and the sides of the base so that it is not necessary to disturb so much of the ground on the sides and at the ends of the individual blocks of the marking device. The alternate staggering of the pegs at the ends makes it possible to install the units end to end and maintain proper staggering of the pegs between adjacently positioned marker devices.

By providing a narrower base I have found that I can position a plurality of three columns of parallel pegs interspaced by a second similar plurality of three columns of pegs alternately spaced with respect to the first plurality of three columns of pegs to give the appearance when viewed from the end as though it had six columns of pegs corresponding with all of the individual columns of pegs.

Also I have found that I can position spaced narrow reinforcing webs extending upwardly from the base to approximately one half of the length of the pegs to reinforce the base and strengthen the individual pegs and hold them in accurate alignment with the desired spacing of the individual rows of marking pegs.

These reinforcing webs are preferably angled to connect with all of the marking pegs in both offset pluralities of rows of pegs to reinforce all of the pegs.

I have also found that by the provision of injection molding I am able to provide hollowed out pegs to effect very substantial materials savings, and at the same time providing a superior assembly wherein the marking pegs are more flexible, and provide a marking device wherein the ends of the pegs are somewhat flexible to provide a degree of "give" in the event that a player inadvertently contacts the marking pegs.

DESCRIPTION OF THE PREFERRED EMBODIMENTS

Figure 2:
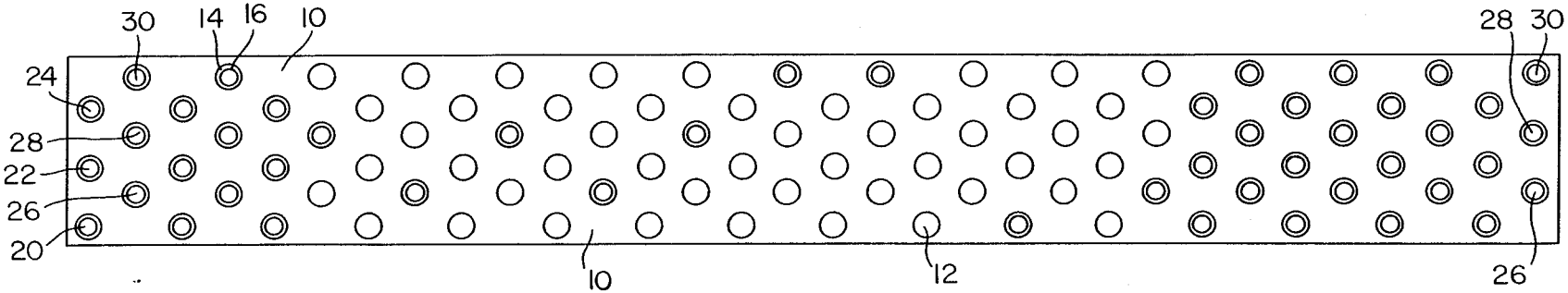
FIG. 2 is a plan view of the assembly of FIG. 1 and showing the alternate lateral spacing of the pluralities of rows of pegs.
Figure 1:
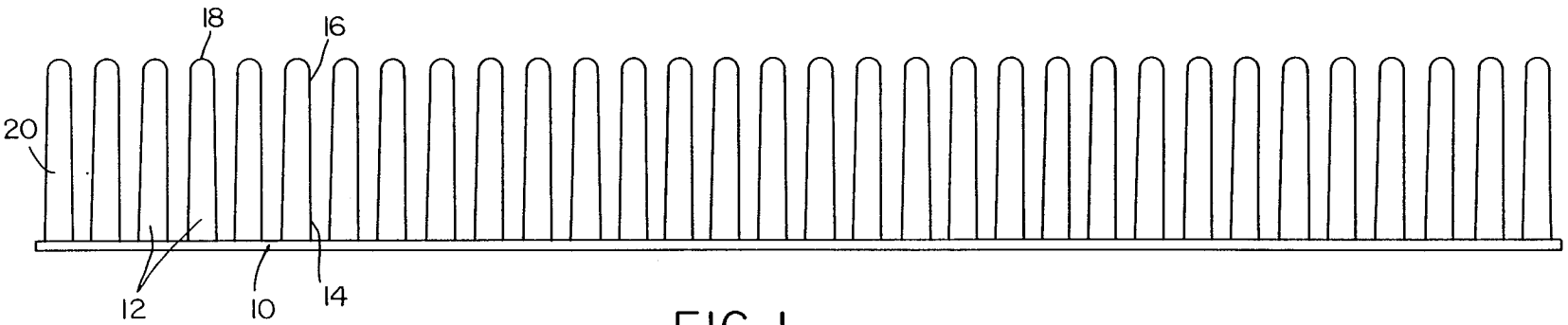
FIG. 1 is a side elevational view of a marker base block consisting of a resilient base and spaced upstanding marking pegs.

Referring now to FIGS. 1 and 2 a segment of a permanent athletic field marker is disclosed. The marker consists of a resilient base 10 provided to support a plurality of upstanding resilient marker pegs 12. The pegs 12 have a slight taper throughout their lengths to facilitate the release of the segment of the field marker from the mold. The marker pegs 12 have rounded resilient tops 18 to deflect light and render the field marker visible, and reduce the deflection of a ball in play and to crush down without injuring a participant in the event that he accidentally falls on the marker.

Figure 4:
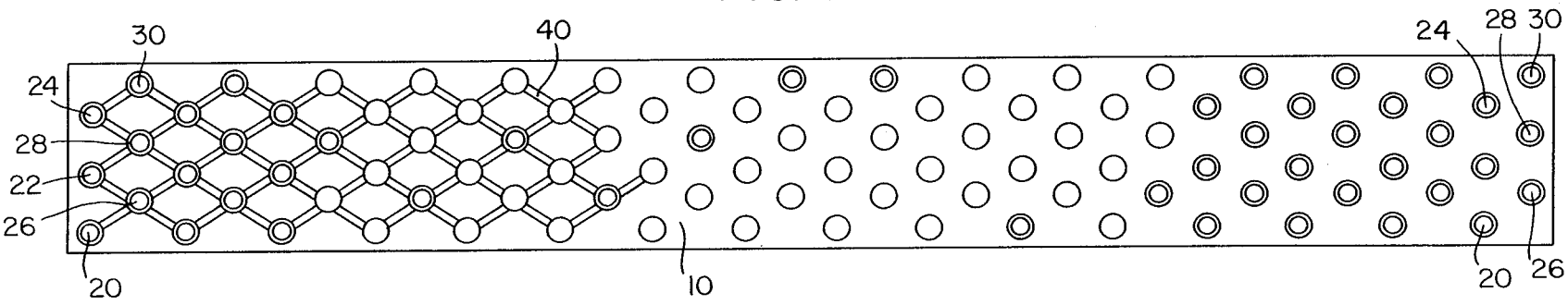
FIG. 4 is a plan view of the modified marker construction illustrated in FIG. 3 and showing the diamond pattern of the peg reinforcement webbing.

As will be observed in FIGS. 2 and 4 the pegs 12 are arranged in three columns 20, 22 and 24. Three additional columns 26, 28 and 30 of pegs 12 are formed on the base 10 and are positioned midway between the columns 20, 22 and 24. It will be noted that the columns of pegs 20, 22 and 24 are positioned closer to the bottom edges of the base 10, and that the columns of pegs 26, 28 and 30 are positioned closer to the top edge of the base 10. In this way with two sets of three columns each it will be apparent that six columns of pegs are concentrated in a narrow spacing. In a situation where the base is three inches wide, we have six columns of pegs concentrated in a very narrow area. At the ends of the marking segments the end row of pegs is positioned at the opposite side of the segment. That is for example at the left hand end as viewed in FIG. 2 the column 20 is adjacent the bottom edge of the segment and at the opposite end the row of pegs 30 is adjacent the top edge of the base segment. In this way it is possible to add additional segments of field markers at the end of the last one applied without losing the patterns of the alternate spacings of the staggered columns. When viewed from above ground and at a distance the alternate spacings of the pegs in columns 20, 22 and 24 and in the columns 26, 28 and 30 provide six columns of marking pegs in the assembly illustrated in FIGS. 1 and 2 and in FIGS. 3 and 4.

Figure 3:
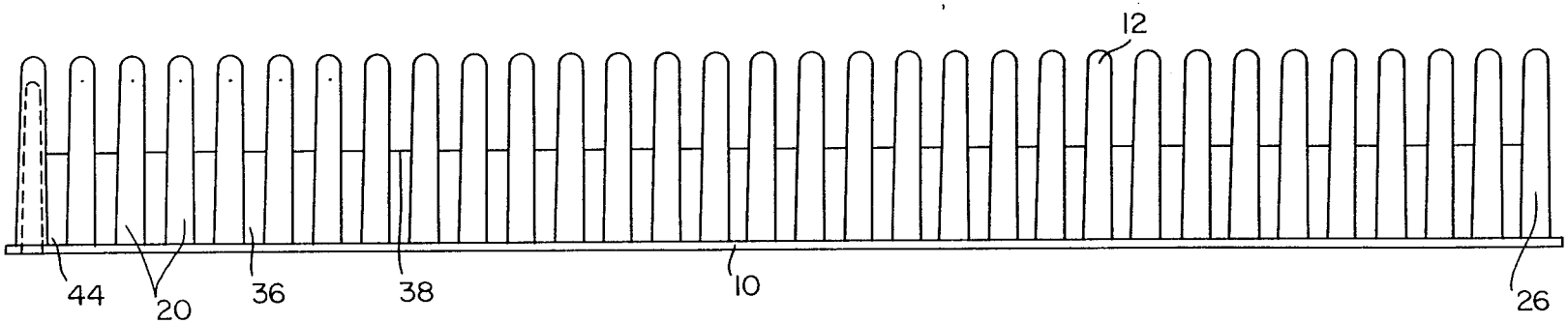
FIG. 3 is a side elevational view of a modified marker construction wherein thin resilient webs interconnect the resilient pegs and extend upwardly from the base to approximately one half of the length of the resilient marking pegs.

Referring now to the embodiment of the invention illustrated in FIGS. 3 and 4, it will be noted that a web 36 extends from the base 10 to each of the pegs 12 in each of the columns 20 to 30 to reinforce the pegs and strengthen the pegs 12 and the base 10. It will be noted that the webs 36 extend angularly and contact each of the pegs 12 as illustrated in FIG. 4.

In the installation of the permanent athletic field markers a readily available conventional trencher, having a blade to dig a 3" wide trench is employed.

The segments of the markers being approximately 3" wide at the base fit into the trench with the pegs 12 projecting upwardly to the surface of the ground. The trench is then filled in with clay or other earth material to compact the earth on the sides of the pegs. After the earth settles it may be necessary to fill the trench again to compensate for shrinkage and settling of the earth.

The base is formed of individual units which are 3" wide and 24" long. Each unit has 96 pegs which project upwardly from the base in three columns of pegs, each column having 16 pegs alternately spaced with respect to 16 ranks of three pegs each alternately spaced with respect to the 16 pegs of each of the three columns of pegs, and the pegs of the 16 ranks of pegs being transversely spaced with the pegs of the three columns of pegs so that six rows of 16 pegs in each row are visible when the athletic field marker is viewed from the end of the marker.

I claim:

1. An athletic field, boundary lines marker comprising a resilient base, a plurality of upstanding resilient pegs projecting upwardly from the base and having relatively flexible round tops, the base with the pegs placed thereon being adapted to be buried in an athletic field with the rounded tops of the pegs visable above ground to mark the boundary lines of athletic events; said field marker further comprising a plurality of thin flexible webs interconnecting said pegs from the base to approximately one half of the length of the pegs, thereby forming a preselected pattern.

2. The invention defined in claim 1 wherein the base is 3" wide and 24" long, and 96 pegs project upwardly from the base in three columns of pegs, each column of pegs having 16 pegs alternately spaced with respect to 16 ranks of three pegs each alternately spaced with respect to the 16 pegs of each of the three columns of pegs, and the pegs of the 16 ranks of pegs being transversely spaced with the pegs of the three columns of pegs so that six rows of 16 pegs in each row are visible when the athletic field marker is viewed from the end of the marker.

* * * * *